US011184710B2

(12) United States Patent
Wahlin

(10) Patent No.: US 11,184,710 B2
(45) Date of Patent: Nov. 23, 2021

(54) HEADBAND COVER FOR DETACHABLE ATTACHMENT TO A HEADBAND OF A HEADPHONE

(71) Applicant: Zound Industries International AB, Stockholm (SE)

(72) Inventor: Erik Wahlin, Lidingö (SE)

(73) Assignee: ZOUND INDUSTRIES INTERNATIONAL AB, Stockholm (SE)

( * ) Notice: Subject to any disclaimer, the term of this patent is extended or adjusted under 35 U.S.C. 154(b) by 0 days.

(21) Appl. No.: 16/980,309

(22) PCT Filed: Feb. 21, 2019

(86) PCT No.: PCT/SE2019/050157
§ 371 (c)(1),
(2) Date: Sep. 11, 2020

(87) PCT Pub. No.: WO2019/177510
PCT Pub. Date: Sep. 19, 2019

(65) Prior Publication Data

US 2021/0037317 A1 Feb. 4, 2021

(30) Foreign Application Priority Data

Mar. 13, 2018 (SE) ..... 1850276-5

(51) Int. Cl.
*H04R 5/033* (2006.01)
*H04R 1/10* (2006.01)

(52) U.S. Cl.
CPC ..... *H04R 5/0335* (2013.01); *H04R 1/1058* (2013.01)

(58) Field of Classification Search
None
See application file for complete search history.

(56) References Cited

U.S. PATENT DOCUMENTS 2,954,442 A 9/1960 Mickenberg
5,329,592 A 7/1994 Altman
(Continued)

FOREIGN PATENT DOCUMENTS

CN 101595738 A 12/2009
CN 102458325 A 5/2012
(Continued)

OTHER PUBLICATIONS

International Search Report for International Application No. PCT/SE2019/050157 dated Apr. 25, 2019.

*Primary Examiner* — Kenny H Truong
(74) *Attorney, Agent, or Firm* — Knobbe, Martens, Olson and Bear, LLP

(57) ABSTRACT

A headband cover (100) for detachable attachment to a headband (20) of a headphone (10), said headband (20) comprising an inner surface (21) wherein; the headband cover (100) is configured to be folded around the headband (20), wherein; —the headband cover (100) comprises a first and a second elongated strip (140, 141) of bendable material, respectively extending along the first and the second elongated edge (110, 120) of the headband cover (100) and having respectively a contact surface (144, 144') configured to abut against the inner surface (21) of the headband, wherein the first and the second strip (140, 141) respectively are configured such that the combined width (W1, W2) of the contact surfaces (144, 144') of the first and the second elongated strip (140, 141) is equal to or less than the width (Wis) of the inner surface (21) of the headband (20).

10 Claims, 4 Drawing Sheets

(56) References Cited

U.S. PATENT DOCUMENTS

| | | | | |
|---|---|---|---|---|
| 2012/0328119 | A1 | 12/2012 | Heise | |
| 2014/0177884 | A1 | 6/2014 | Minarki et al. | |
| 2018/0302708 | A1* | 10/2018 | Monaghan ..... | H04R 1/1091 |

FOREIGN PATENT DOCUMENTS

| | | | |
|---|---|---|---|
| CN | 204392512 | U | 6/2015 |
| CN | 206061090 | U | 3/2017 |
| CN | 106658254 | A | 5/2017 |
| CN | 207766491 | U | 8/2018 |
| EP | 2566191 | A2 | 3/2013 |
| EP | 2986027 | A1 | 2/2016 |
| WO | WO 2016/024895 | | 2/2016 |
| WO | WO 2017003346 | A1 | 1/2017 |

* cited by examiner

HEADBAND COVER FOR DETACHABLE ATTACHMENT TO A HEADBAND OF A HEADPHONE

CROSS REFERENCE TO RELATED APPLICATIONS

This application is a U.S. National Phase Application of PCT International Application Number PCT/SE2019/050157, filed on Feb. 21, 2019, designating the United States of America and published in the English language, which claims priority to Sweden Application No. 1850276-5, filed Mar. 13, 2018. The disclosures of the above-referenced applications are hereby expressly incorporated by reference in their entireties.

TECHNICAL FIELD

The present disclosure relates to a headband cover for a headband of a headphone. The present disclosure also relates to a headband of a headphone comprising a headband cover. The present disclosure further relates to a headphone comprising a headband with a headband cover.

BACKGROUND ART

A headphone typically comprises a headband which supports the headphone on the head of the wearer. A pair of headphones may be interconnected by a headband into a headset. The headband may comprise a cover which envelopes the headband in order to protect or hide electric wiring connected to the headphone and to provide cushioning between the headband and the head of the user. Prolonged use may result in that the headband cover becomes worn or soiled and needs to be replaced. Headbands are also considered a fashion accessory and as such there is a need for adapting the appearance of the headband.

WO2016024895 shows an interchangeable headband cover which is divided in a front section that is applied onto the outer surface of the headband and two side sections that are wrapped around the headband and meet on the inner surface of the headband. To lock the headband cover in place, fastening elements such as Velcro are arranged on the side sections. In one embodiment, shown in FIG. 5, the headband cover 240 comprises an elliptical central section 241 and two outer sections 242, 243 which are foldable attached to the respective sides of the central section 240. The elliptical configuration of the central section and the corresponding shape of the outer sections causes the headband cover to strive towards a folded state as shown in FIG. 5*b* so that the headband cover remains in folded state on the headband. To avoid deformation during folding, reinforcing bendable plastic elements are arranged across the entire width of the respective central and side sections, see FIG. 8*c*.

There is a need for exchangeable headband covers that allows for easy mounting and dismounting onto the headband of a headset and that fits well shape of the headband.

SUMMARY OF THE DISCLOSURE

It is a general object of the present disclosure to provide a detachable headband cover for a headband of an earphone that is easy to mount and dismount onto the headband. Moreover it is an object of the present disclosure to provide a detachable headband cover that remains stable in mounted state on the headband. Yet a further object of the present disclosure is to provide a detachable headband that conforms well to the shape of the headband in folded state.

According to the present disclosure this and other objects are met by a headband cover 100 for detachable attachment to a headband 20 of a headphone 10.1, 10.2, said headband 20 comprising an inner surface 21 which, in use, is directed towards the head of the wearer, wherein;

the headband cover 100 has a length (L) and a width (W) and first and second parallel edges 110, 120 extending along the length (L) and wherein the width (W) of the headband cover 100 is configured such that the headband cover 100 may be folded around the headband 20, characterized in that;

the headband cover 100 comprises a first and a second elongated strip 140, 141 of bendable material respectively extending along the first and the second edge 110, 120 of the headband cover 100 and having respectively a contact surface 144, 144' configured to abut against the inner surface 21 of the headband, wherein the first and the second strip 140, 141 respectively are configured such that the combined width (W1, W2 of the contact surfaces 144, 144' of the first and the second elongated strip 140, 141 is equal to or less than the width (Wis) of the inner surface 21 of the headband 20.

When the headband cover according to the present disclosure is folded around a headband the curvature of the elongated strips will exert a pressure onto the inner surface of the headband which effectively holds the headband in place on the headband in folded condition. Auxiliary fasteners may thus be omitted. Surprisingly, it has been found that a sufficient clamping effect is achieved also with a relatively narrow elongated strips, e.g. strips having a width less than half the width of the inner surface of the headband. This in turn provides an advantage in that the major part of the headband cover may be manufactured in soft and pliable cover material and thus neatly follow the shape of the headband and electrical wiring therein without deformation or wrinkling. The small amount of strip material utilized in the headband cover further results in reduced manufacturing costs.

Moreover, it is an object of the present disclosure to provide a headband cover for a headband of an earphone which conforms to the shape of the headband. It is also an object of the present disclosure to provide a headband cover for a headband of an earphone which may be produced at low cost.

In an embodiment of a headband 20 for a headphone 10, the inner surface 21 of the headband 20 comprises a recess 22 extending longitudinally along at least a portion of the inner surface 21 of the headband 20. The recess 22 is thereby configured to receive the contact surfaces 144, 144' of the first and the second elongated strips 140, 141 of the headband cover 100. The recess 22 in the headband 10 prevents the flexible strips 140, 141 from separating and ensures that the headband cover 100 remain secured in folded state around the headband 10.

Further features and embodiments of the headband cover according to the present disclosure is disclosed in the detailed description and the appended claims.

DETAILED DESCRIPTION OF EMBODIMENTS

The headband cover according to the present disclosure will now be described more fully hereinafter. The headband cover according to the present disclosure may however be embodied in many different forms and should not be construed as limited to the embodiment set forth herein. Rather, this embodiment is provided by way of example so that this disclosure will be thorough and complete, and will fully convey the scope of the present disclosure to those persons skilled in the art.

Figure 1:
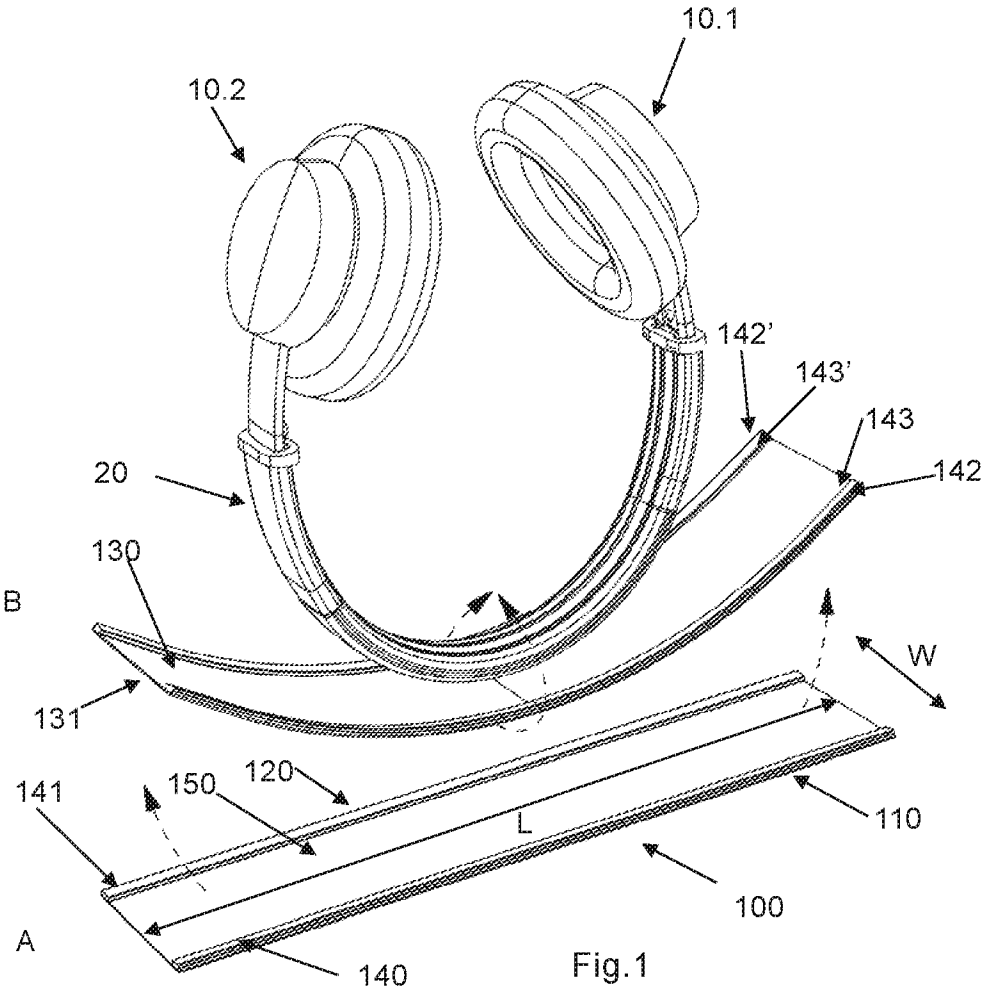
FIG. 1: A schematic drawing of a headband cover according to the present disclosure.

FIG. 1 shows a headband cover 100 according to the present disclosure in an initial flat position A and in a state B in which the headband cover is being folded around a headband 20 which is coupled to two headphones 10.1, 10.2.

Figure 2:
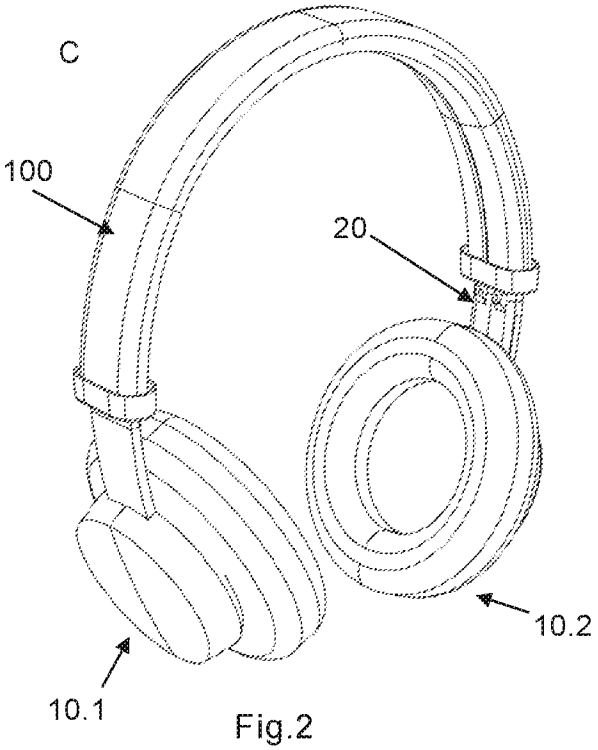
FIG. 2: A schematic drawing of a headband with a headband cover according to the present disclosure.

FIG. 2 shows the headband cover 100 in a state C in which the headband cover 20 is folded over the headband 20.

Turning to FIG. 1. The headband cover 100 is elongated and comprises opposing first and second elongated edges 110, 120 which extends along the length L of the headband cover 100. The distance between the first and second elongated edges 110, 120 defines the width W of the headband cover 100. As shown in FIG. 1, the headband cover 100 may be rectangular. The width W is adapted so that the headband cover 100 may be folded around the headband 20 to a state in which both elongated edges 110, 120 are arranged adjacent each other on the inner surface 21 of the headband 20 (see FIG. 3*b*). The length L of the headband cover 100 is selected such that the headband cover 100 covers at least a portion of the headband 20 between the first and the second headphone 11.1, 11.2. Both length L and width W of the headband cover 100 may be selected in view of the dimensions of the headband 20 in question.

The headband cover 100 further has an inner side 130 which in folded state C faces the headband 20 and an opposing outer side 131 which in folded state C faces away from the headband 20.

The headband cover 100 comprises cover material 150. The cover material 150 may be pliable such that it may be folded over a headband of a headphone. For example, the cover material 150 may comprise textile or plastic or leather or combinations thereof. For example, the cover material 150 may be a sheet of pliable cover material. The cover material 150 may be an integral piece as shown in FIG. 1. Alternatively, the cover material 150 may comprise several sections that have been joined together as described in WO2016024895. The cover material 150 may also include components such as padding material or the like.

According to the present disclosure, the headband cover 100 comprises a first and a second elongated strip 140, 14 which are manufactured of bendable material. That is, a material which may be bent by hand from a generally straight shape to an arc-shape without breaking or twisting. Preferably, the bendable material maintains substantially it's length L when it is bent. The bendable material may permanently maintain the arc-shape after bending. Alternatively, the bendable material may be flexible such that it may be bent into an arc-shape by the force of hand of a user and return to its original shape when the force is removed from the material. For example, the first and the second elongated strips are manufactured from polypropylene, (PP) or polyethylene terephthalate (PET) or polyvinyl chloride (PVC) or polycarbonates (PC) or thermoplastic elastomers (TPE) or thermoplastic polyurethane (TPU) or polyethylene (PE) or acrylonitrile butadiene styrene (ABS) or metal such as spring steel.

Figure 5A:
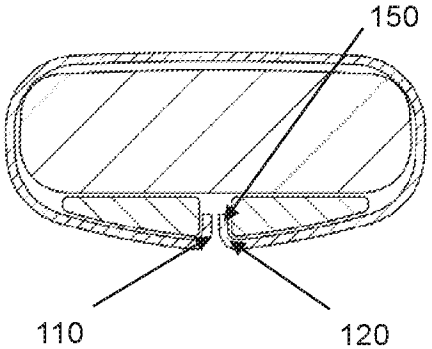
FIGS. 5*a*, 5*b*: Cross-sectional views of a headband with a headband cover according to embodiments of the present disclosure.
Figure 5B:
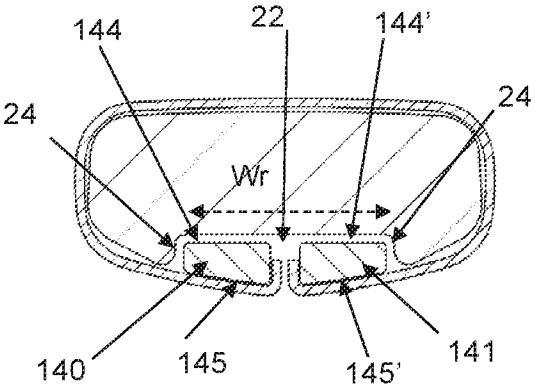

The first elongated strip 140 extends along the first elongated edge 110 of the headband cover 100 and the second elongated strip 141 extends along the second elongated edge 120 of the headband cover 100. The elongated strips 140, 141 may thereby extend at least a portion the length L of the headband cover 100 along the entire length L of the headband cover 100. The first elongated strip 140 comprises a first longitudinal strip edge 142 and a second longitudinal strip edge 143. The second elongated strip 141 comprises a first longitudinal strip edge 142' and a second longitudinal strip edge 143'. The distance between the first and second longitudinal strip edges defines the strip width of the first and second elongated strips 140, 141. The first and the second longitudinal strip 140, 141 may form the elongated edges 110, 120 of the headband cover 100. However, typically the first and the second longitudinal strip 140, 141, may be arranged adjacent the respective first and the elongated second edges 110, 120 of the headband 100. For example, as shown in FIG. 5*b*, where a small portion of cover material 150 forms the elongated edges of 110, 120 of the headband 100.

As shown in FIG. 1, the first longitudinal strip 140 is arranged such that the first longitudinal edge 142 extends along the first elongate edge 110 of headband cover 100. The second longitudinal strip 141 is arranged such that the first longitudinal edge 142' extends along the second elongated edge 120 of headband cover 100. The second longitudinal edges 143, 143' of the first and second elongated strips 140, 141 are directed towards the center of the headband cover (indicated by the arrow L). Thus, cover material 150 extend between the inner edges 142, 142' of the first and the second elongated strips 140, 141.

The headband cover 100 may be manufactured by attaching a first and a second elongated strip 140, 141 to opposing elongated edges of a, preferably rectangular, cover material 150. The elongated strips 140, 141 may be attached to the cover material by e.g. heat molding, ultrasonic welding or by tape.

Figure 3:
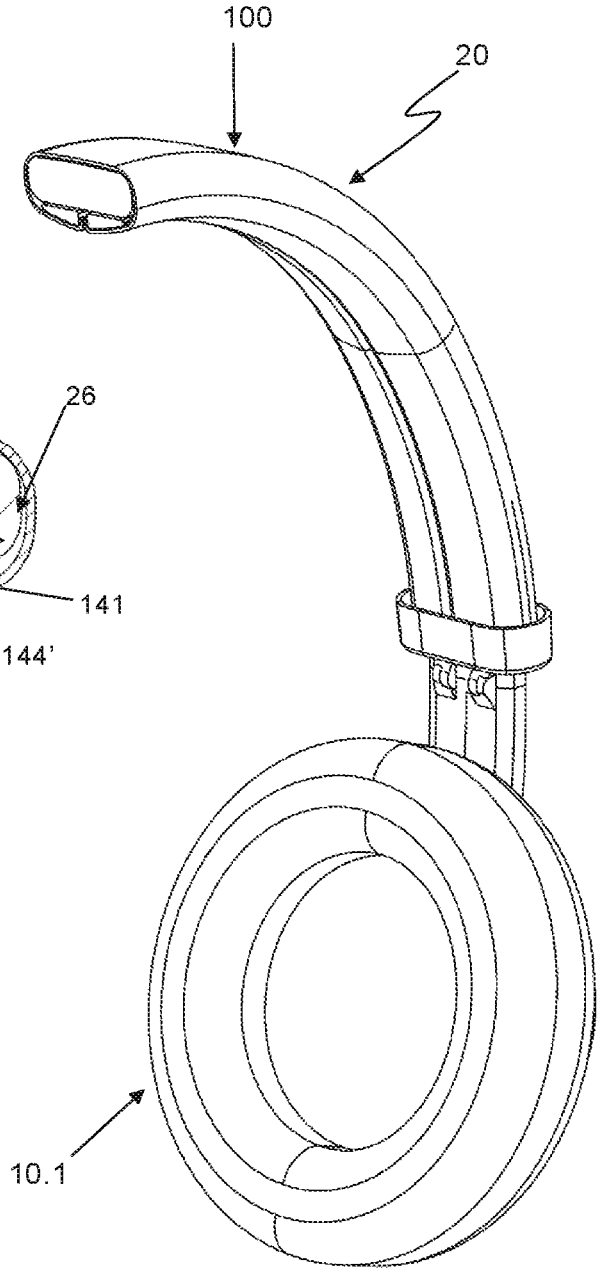
FIG. 3: A schematic cross-sectional drawing of a headband with a headband cover according to the present disclosure.

FIG. 3 shows a cross-sectional view of the headband 20 and the headband cover 100 of FIG. 2.

Figure 4:
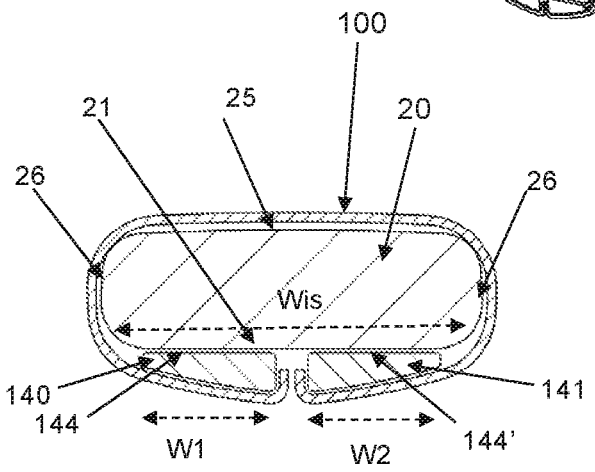
FIG. 4: A enlarged view of the cross-section of FIG. 3.

FIG. 4 is an enlarged view of the cross-section of FIG. 3. Thus, the headband 20 comprises an outer surface 25, which in use is directed away from the head of the wearer (not shown) and an inner surface 21 which, in use, is directed towards the head of the wearer. Opposing side surfaces 26 extend between the outer surface 25 and the inner surface 21. The width Wis of the inner surface 21 is indicated by the dashed arrow. The width Wis of the inner surface 21 is determined in direction from one of the opposing side surfaces 26 to the other of the opposing side surfaces 26

The first and the second elongated strips 140, 141 comprises a respective contact surface 144, 144' which is configured to abut against the inner surface 21 of the headband 20. The contact surfaces 144, 144' is a portion of the cross-section of first and the second elongated strip that is intended to, in use, contact the inner surface 21 of the headband 100. In the embodiment of FIG. 4 the contact surface 144, 144' extends over the entire width of the first and the second elongated strip 140, 141. However, the contact surface 144, 144' may extend over merely a portion of the width of the first and second elongated strip 140, 141. The shape of the contact surfaces 144, 144' may be designed in dependency of the shape of inner surface 21 of the headband 20. In the embodiment of FIG. 3*b*, the inner surface 21 of the headband 100 is flat, i.e. planar and therefore the contact surface is flat. However, the contact surfaces 144, 144' may have other shape. For, example (not shown), if the inner surface 21 of the headband is concave the contact surface 144, 144' of the elongated strips may be convex to ensure good abutment with the inner surface 21. The width of each strip 140, 141 may be equal to, less than or greater than the width Wis of inner surface 21 of the headband.

The first and the second elongated strip are configured such that the combined width W1 of the first contact surface 144 and the width W2 of the second contact surface 144' is equal to or less than the width Wis of the inner surface 21 of the headband 20. The width W1 and W2 of the first and the second contact surface 144, 144' may be equal to each other or different from each other. In detail, the width W1 of the first contact surface 144 and the width W2 of the second contact surface 144' are respectively equal to or less than half the width Wis of the inner surface 21 of the headband. It is thereby preferred that the width W1 of the first contact surface 144 is equal to the width W2 of the second contact surface 144'. This ensures that the elongated edges 110, 120 of the headband cover 100 meet in the center of the inner surface 21 of headband cover 100. This is advantageous because the separation line between the elongated edges 110, 120 are concealed when the headband is worn on the head of a user.

FIG. 5*b* shows further features of the headband cover 100 according to the present disclosure. The first and the second elongated strip 140, 141 comprises a respective attachment surface 145, 145' which is arranged opposite to the contact surface 144, 144'. The contact surfaces 145, 145' may be attached to the cover material 150 by e.g. gluing.

Figure 6:
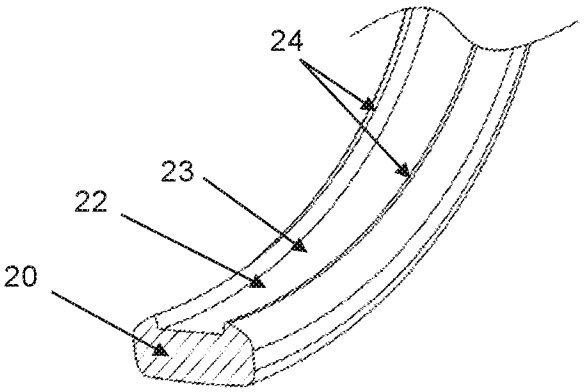
FIG. 6: A schematic drawing of a headband according to an embodiment of the present disclosure.

According to a preferred embodiment, the first and the second contact surfaces 144, 144' are configured to extend into a recess 22 formed in the inner surface 21 of the headband 20. FIG. 6 shows a headband 20 having a recess 22. The recess 22 extends longitudinally along the inner surface 21 of the headband. The recess 22 has first and second opposing side walls 24 which defines the depth of the recess and a bottom surface 23 having a width Wr which defines the width of the recess 22. The width of the recesses is thus less than the width Wis of the inner surface 21 of the headband 20.

The first and the second contact surfaces 144, 144' of the elongated strips 140, 141 are configured to extend into the recess 22 and to abut against the bottom surface 23 of the recess 22. The first and the second elongated strips 140, 141, may thereby be configured such that the contact surface 144, 144' protrudes a predetermined distance from the respective attachment surfaces 145, 145'. The distance may be selected in dependency of the depth of the recess 22 and may be equal, or greater or less than the depth of the recess 22. Preferably, the contact surface 144, 144' protrudes a predetermined distance from the respective attachment surfaces 145, 145' that is equal or greater than the depth of the recess 22. The combined width W1 and W2 of the contact surfaces 144, 144' of the first and the second elongated strip 140, 141 may be equal to or less than the width Wr of the recess 22 as disclosed hereinabove. A main advantage of the embodiment shown in FIG. 5*b* is that the opposing side walls 24 of the recess supports the second longitudinal edges 143, 143' of the elongated strips 140, 141. This prevents lateral movement of the headband cover on the headband. It also provides a comfortable wearing experience of the headband since the side directed towards the head of the wearer is substantially even.

Figure 7A:
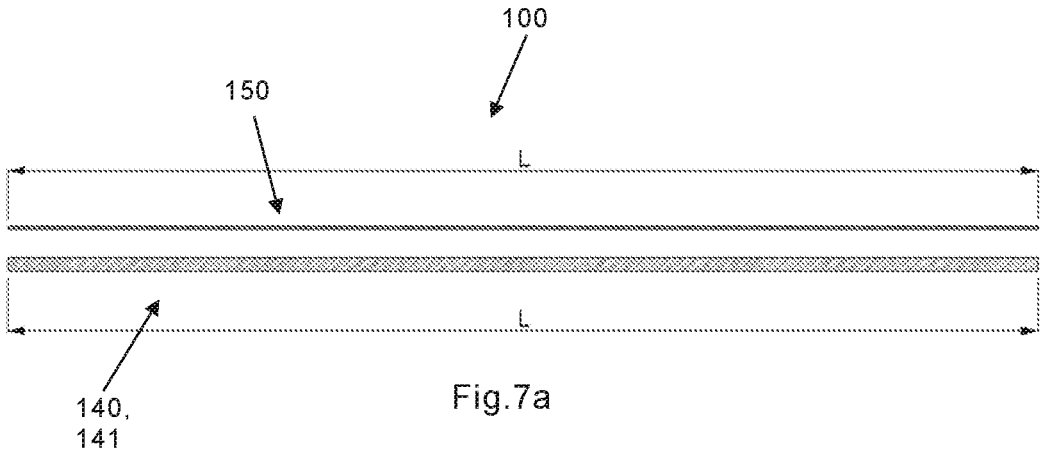
FIGS. 7*a* and 7*b*: Schematic drawings explaining the function of the headband cover according to the present disclosure.
Figure 7B:
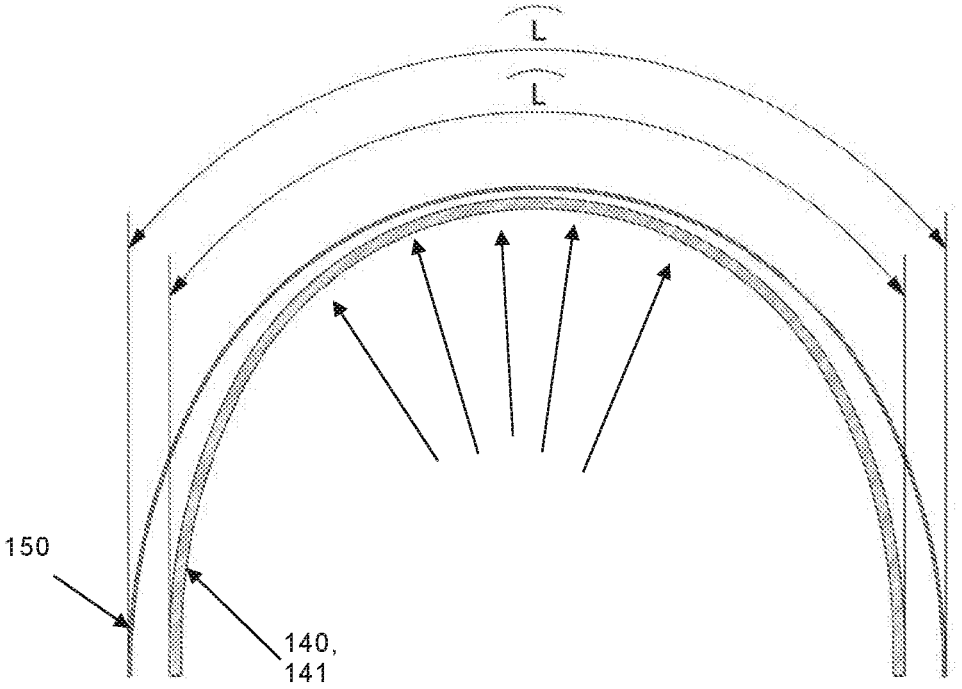

The functional principle of the headband cover according to the present disclosure is hereinafter schematically explained with reference to FIGS. 7*a* and 7*b*. FIG. 7*a* shows a situation in which the headband cover 100 is folded in flat condition (see FIG. 1). In this situation the lengths L of the elongated strips 140, 141 and the length of the cover material 150 between the elongated strips 140, 141 is equal. The elongated strips 140, 141 are therefore relaxed and no forces acts of the elongated strips. FIG. 7*b* shows a situation in which the headband cover 100 of FIG. 7*a* is folded around an arced headband (not shown), the elongated strips 140, 141 thereby extends on the inner side of the headband and the cover material 150 extends of the outer surface of the headband. Due to the curvature of the headband, the arc length L of the elongated strips 110, 12 is shorter than the arc length L of the cover material 150 on the outer surface of the headband. The elongated strips 140, 141 will therefore strive towards increasing their arc lengths L and are thus forced into firm abutment with the inner surface of headband.

Although a particular embodiment has been disclosed in detail this has been done for purpose of illustration only, and is not intended to be limiting. In particular it is contemplated that various substitutions, alterations and modifications may be made within the scope of the appended claims.

Moreover, although specific terms may be employed herein, they are used in a generic and descriptive sense only and not for purposes of limitation. Furthermore, as used herein, the terms "comprise/comprises" or "include/includes" do not exclude the presence of other elements. Finally, reference signs in the claims are provided merely as a clarifying example and should not be construed as limiting the scope of the claims in any way.

The invention claimed is:

1. A headband cover for detachable attachment to a headband of a headphone, said headband comprising an inner surface which, in use, is directed towards the head of the wearer, wherein;

the headband cover has a length and a width and first and second parallel elongated edges extending along the length and wherein the width of the headband cover is configured such that the headband cover may be folded around the headband; and the headband cover comprises a first and a second elongated strip of bendable material, respectively extending along the first and the second elongated edge of the headband cover and having respectively a contact surface configured to abut against the inner surface of the headband, wherein the first and the second strip respectively are configured such that the combined width of the contact surfaces of the first and the second elongated strip is equal to or less than the width of the inner surface of the headband.

2. The headband cover according to claim 1, wherein the width of the contact surface of the first elongated strip and the width of the contact surface of the second elongated strip respectively are equal to or less than half the width of the inner surface of the headband.

3. The headband cover according to claim 1, wherein the headband cover comprises cover material, wherein the first and the second elongated strip are arranged such that a first longitudinal edge of the first elongated strip extends along the first elongated edge of the headband cover and such that a first longitudinal edge of the second elongated strip extends along the second elongated edge of the headband cover and such that the cover material extends between a second longitudinal edge of the respective first and second elongated strip.

4. The headband cover according to claim 3, wherein the first and the second strip comprises an attachment surface arranged opposite to the contact surface, wherein the attachment surface is attached to the cover material.

5. The headband cover according to claim 4, wherein at least a portion of the contact surface of the first and the second elongated strip protrudes in a direction away from the attachment surface.

6. The headband cover according to claim 1, wherein the contact surfaces of the first and the second elongated strips are configured to extend into a recess in the inner surface of the headband.

7. A headband for a headphone being configured to extend along a portion of a head of a wearer and having an inner surface directed towards the head of the wearer, and wherein the headband cover according to claim 1 is detachably attachable to the headband.

8. The headband according to claim 7, wherein the inner surface of the headband comprises a recess extending longitudinally along at least a portion of the inner surface of the headband, wherein the recess is configured to receive the contact surfaces of the first and the second elongated strips.

9. The headband according to claim 8, wherein the recess comprises first and second opposing side walls defining the depth of the recess and a bottom surface having a width, wherein the combined width of the first and the second contact surface is equal to or less than the width of the bottom surface of the recess.

10. A headphone comprising the headband according to claim 7.

* * * * *